US007509985B2

(12) United States Patent
Metsch

(10) Patent No.: US 7,509,985 B2
(45) Date of Patent: Mar. 31, 2009

(54) HANDBAG—WITH NOVEL FEATURES

(76) Inventor: Beth Metsch, 1859 S. Washington St., Denver, CO (US) 80210-3213

( * ) Notice: Subject to any disclaimer, the term of this patent is extended or adjusted under 35 U.S.C. 154(b) by 673 days.

(21) Appl. No.: 11/194,949

(22) Filed: Aug. 1, 2005

(65) Prior Publication Data

US 2007/0044878 A1 Mar. 1, 2007

(51) Int. Cl.
*A45C 13/08* (2006.01)

(52) U.S. Cl. ..... 150/127; 150/128; 150/129; 383/105; 383/114; 190/903; 2/301

(58) Field of Classification Search ..... 150/127–130; 383/105, 114, 109, 111; 190/903; 2/301
See application file for complete search history.

(56) References Cited

U.S. PATENT DOCUMENTS 3,443,671 A * 5/1969 Dyke ..... 190/103
4,361,215 A * 11/1982 Sawai ..... 190/18 A
4,710,983 A * 12/1987 Markoff ..... 2/301
4,733,759 A * 3/1988 Shih-Chen ..... 190/18 A
6,647,555 B2 * 11/2003 Yamaguchi et al. ..... 2/338
D504,226 S * 4/2005 Heatherwick ..... D3/233
D504,565 S * 5/2005 Heatherwick ..... D3/233
D505,259 S * 5/2005 Heatherwick ..... D3/233
D543,697 S * 6/2007 Heatherwick ..... D3/233

* cited by examiner

*Primary Examiner*—Tri M Mai
(74) *Attorney, Agent, or Firm*—Morriss O'Bryant Compagni

(57) ABSTRACT

A handbag or hand-carried container formed with successive tiers of a spiraled compound tape having attachment means on each side edge of the tape. The spiraled tape is adapted for securely fastening successive tiers of the spiraled tape together to form a hand carried container. The compound tape is configured to repeatedly form and disassemble a handbag of a specific size and shape and to provide a protective lining within the fully formed handbag or container.

8 Claims, 6 Drawing Sheets

14
26
46
38
42
40
50
16
4
4
30
20
36
28
18
22
32

HANDBAG—WITH NOVEL FEATURES

BACKGROUND OF INVENTION

Field of Invention

The present invention relates to improved novel handbags and hand-carried containers with a unique construction.

Attractive handbags and cosmetic bags for the busy fashionable woman must provide a safe, secure container free of risk of marring objects placed within the handbag being carried about and during travel; such a handbag must be of light-weight construction, and for temporary storage when not in use, storable as a flat object in the minimum volume of space.

Earlier inventors have disclosed clothing support items having the form of belt-like elongated tape structures equipped along the edges thereof with slide fasteners or snap fasteners. These earlier belt-like articles were invented to provide support means for a person's garments and simultaneously a secure support means for carrying other objects such as a camera, cell phone, sun glasses or even a wet bathing suit. These earlier inventions utilized belt-like objects with longitudinally attached slide fasteners to form an enclosure or purse which then accommodated carrying an object. All of these earlier inventions were primarily structured to provide component parts and features for support of a persons garment such as a waist belt or provide a belt-like object to hang from a persons neck. Examples of two of these earlier multiple purpose inventions which featured dual purpose belt-like component parts with slide fasteners longitudinally attached are found in U.S. Pat. No. 6,647,555 Yamaguchi and U.S. Pat. No. 4,710,983 Markoff. These earlier inventions are provided with additional features such as extra fasteners, openings and attachments for garment support on their belt-like objects, which additional fasteners or openings result in limiting the means for forming enclosures or purse like containers of the desired shapes. Moreover, these earlier inventions often projected metal on other hard materials interior to whatever purse or container were formed. These metal or hard surfaces exposed objects placed inside the container or purse to scratches or marring when carried about.

These earlier disclosed dual purpose slide fastener tape devices were limited to forming a purse or hand-carried container having only certain cylindrical or triangular shapes. None of the earlier disclosed slide fastener tape constructed handbags or hand-carried containers provide for a firm shaped bottom panel or for having other geometric features in the resulting container such as desirable to provide a fashionable dependable handbag or purse. The dual purpose devices are restricted in size to the requirements to form first a garment support article and only secondarily to form a useful handbag or hand-carried container. Larger sized handbags or hand-carried containers could not be formed from the limited tape dimensions and structures used in the dual purpose references.

A further limitation in the earlier references is the fact none of the earlier slide fastener tape dual purpose references disclose means for providing a protective liner for the resultant purse or hand-carried container formed from the dual purpose slide fastener tapes.

SUMMARY OF THE INVENTION

The present invention is intended for one purpose only, to provide a novel construction for a fashionable handbag or cosmetic purse or hand carried container. Such a handbag or container that is light weight, stores, when not in use in a flat minimal space, and is free from protrusions or surfaces within the interior of the container enclosure that could scratch or mar objects carried therein.

It is a first object of my invention to provide a novel handbag or hand-carried container of predetermined shape formed of a single compound structured, longitudinal lightweight tape having slide-fastener attachments secured along the peripheries or edges of the tape.

It is also an object of my intention to provide a novel handbag or hand-carried container of pre-determined shape formed of a single compound longitudinal light-weight tape having a series of readily engageable fastener attachments other than slide fasteners secured along the peripheries or edges of the tape.

It is another object of my invention to provide a novel handbag or hand-carried container which may be disassembled and stored in a flat, minimal space when not in use.

Still another object of my invention is to provide a novel handbag or hand carried container utilizing an elongated lightweight compound tape with slide fasteners attached thereto which when fastened to form a container, the interior of which is free from projecting metal or abrasive fastener components which would scratch or mar objects placed in the interior of the container.

These and other objects and advantages of my invention will be apparent from the following drawings, specifications and claims.

DETAILED DESCRIPTION OF DRAWINGS

Figure 1:
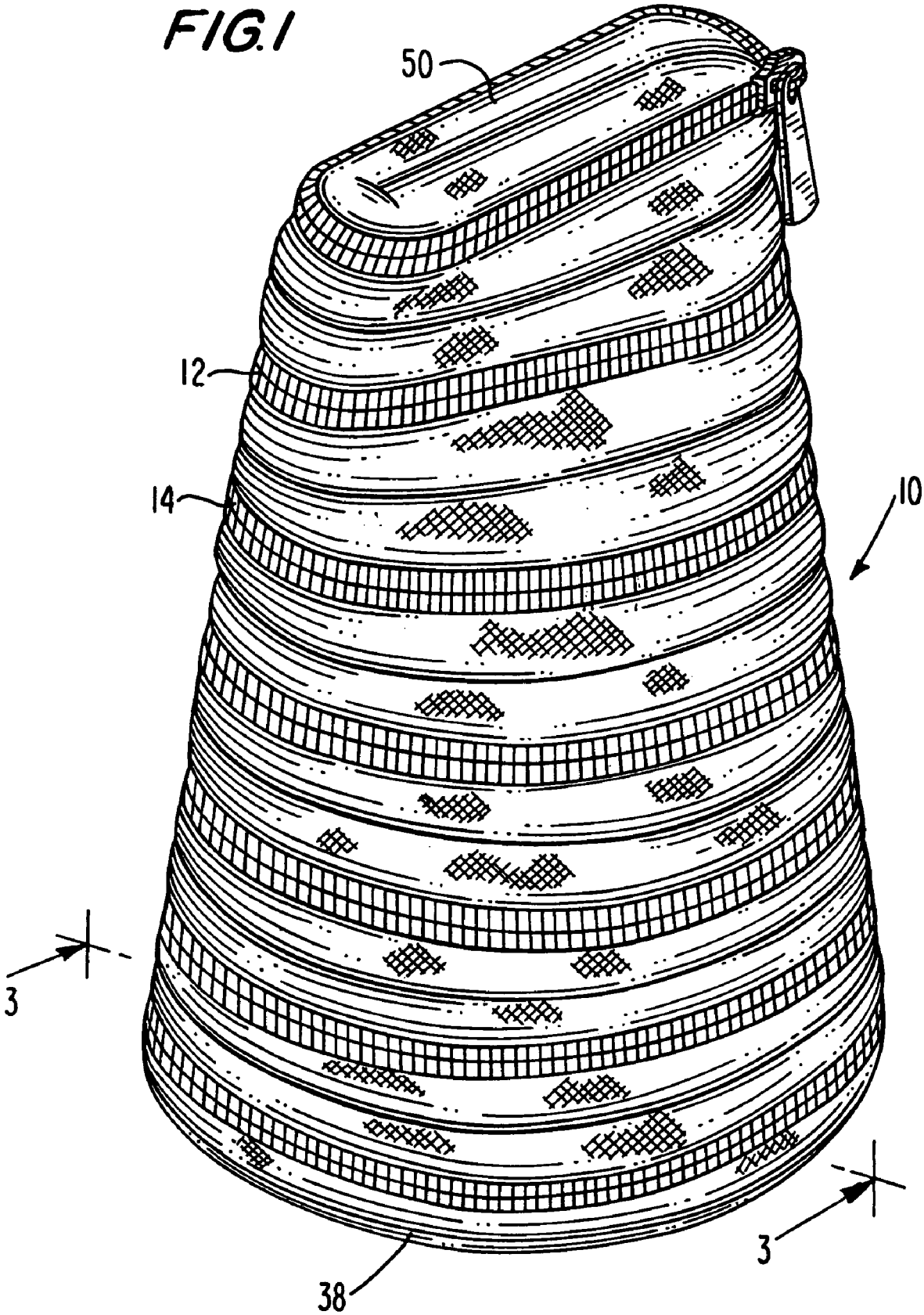
FIG. 1 is a perspective view of a first embodiment of the invention showing a fully formed handbag constructed with a single elongated compound tape.

A first embodiment of my invention is illustrated in FIGS. 1 through 5. FIG. 1 is a perspective view of a fully formed handbag 10, which has been constructed by attaching along the peripheral edges respectively, successive sections of a compound tape 14 shown in detail in FIGS. 2 and 4.

The compound tape 14 is comprised of two slide fastener tapes 16, 26. Tape 16 is comprised of an elongated strip of fabric or other flexible material having slide fastener attachment teeth 18 secured along the edge or periphery thereof. The tape 16 has a upper side 20 and a lower side 22 slide fastener tape 26, similar in all ways with tape 16 has slide fastener attachment teeth 28 along one edge thereof.

Tape 26 has an upper side 30 and lower side 32. The upper sides 20, 30 of the two tapes 16 and 26 are securely fastened longitudinally by a sewn seam 36 or other secure fixedly attachment means.

Figures 2, 3, 4:
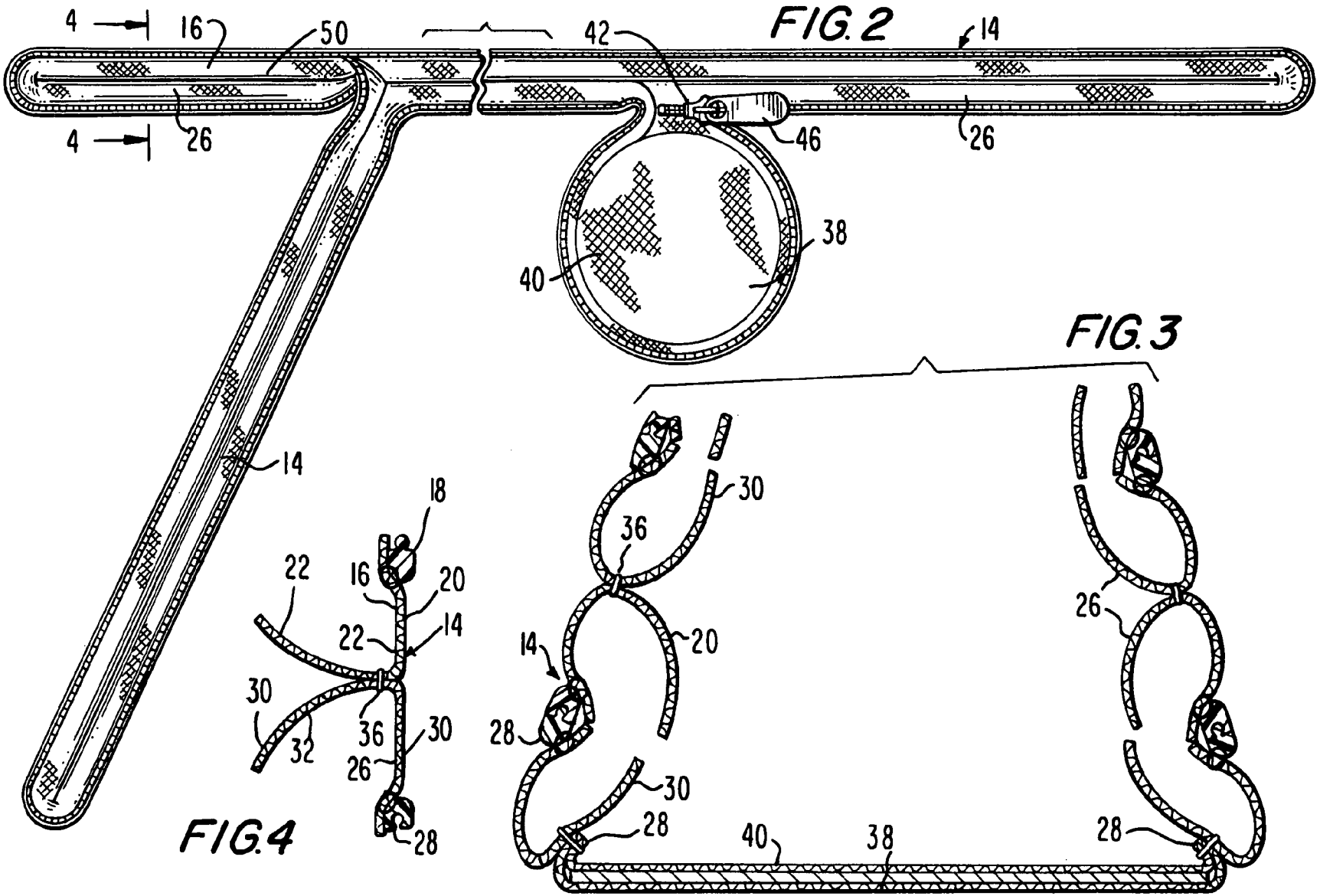
FIG. 2 is a plan view of an elongated compound tape used to form the handbag shown in FIG. 1.
FIG. 3 is a cross section view on plane 3-3 of the handbag shown in FIG. 1.
FIG. 4 is a cross section view of the compound tape shown on plane 4-4 in FIG. 2.

FIG. 3 is a cross section view of the handbag 10 shown in FIG. 1. A bottom panel 38 comprised of a flat stiff material such as post-board or thickened polymer sheet forms the flat base or bottom of the handbag 10. A fabric or other flexible cover material 40 covers both the interior and exterior surfaces of the bottom panel 38.

FIG. 2 shows a bottom panel 38 attached along a section of the periphery thereof at 42 by a sewn seam or other secure attachment means to the edge of tape 26.

Figure 5:
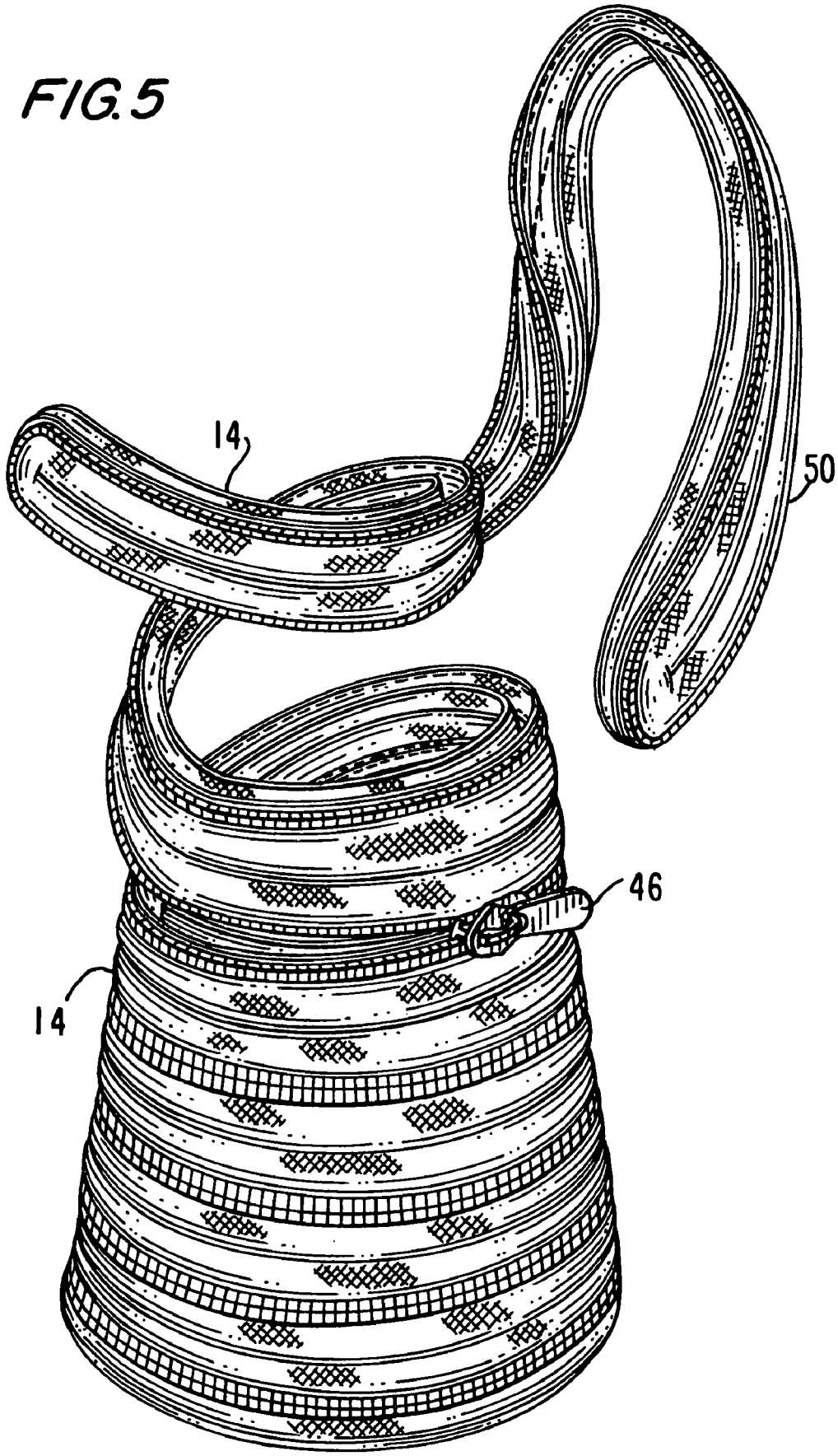
FIG. 5 is a perspective view of the first embodiment of the invention illustrated in FIG. 1 showing a partly formed handbag.

The sequence of slide fastener attachment teeth 28 attached to the edge of tape 26 is extended about the periphery of the bottom panel liner 40. When the slide fastener moveable member 46 engages the attachment teeth along successive sections of the compound tape 14, the bottom panel 38 is secured in place as the first tier of the spiral formed handbag or container. FIG. 5 illustrates the spiral construction method described above.

The compound tape 14 is provided with a short extension 50. The tape extension 50 when attached to a successive interval or tier of the compound tape 14 forming a handbag or container, the section 50 of the compound tape becomes the cover of or upper most tier of the handbag when closed. The compound tape 14 shown in FIG. 2 is provided with a stiff or rigid bottom panel 38, secured as shown in FIG. 2 to the edge of one slide fastener tape 26. When the slide fastener moveable member 46 is moved to close the first tier of the spiral handbag, the bottom panel 38 is secured in place and becomes the base or bottom of the handbag 10 as shown in FIG. 1.

It is understood that other geometric shapes, such as rectangular, oval, or square can be substituted for the circular bottom panel 38 shown in FIGS. 2 and 3.

It is also further understood that slide fasteners shown attached to the peripheral edges of the compound tape 14 are convenient but other fastener means are also suitable. Examples of alternative fastener means include interlocking velcro strips, metallic snap fasteners with metallic male and female components and other fastener techniques.

FIG. 5 is a perspective view of a partly formed handbag such as illustrates in FIG. 1 at 10. The cover or top section 50 of the compound tape 14 is shown extending as an oblique angle in FIG. 2 from the main section of compound tape 14. The slide fastener mobile member 46 is shown joining successive sections of compound tape 14.

When a handbag 10 or container is formed it has an interior and an exterior. The interior is provided with elongated folded sections of the attached slide fastener tapes 16 and 26/ The folded sections are sufficiently wide when folded to cover any interiorly projected metal or hard surface components of the slide fastener or other fasteners if such are used which could scratch or mar objects placed in the interior of the handbag or container. The compound tape 14 construction as described above provides a method and apparatus to form a securely constructed handbag or hand-carried container with a flexible protective interior liner. Sensitive or highly finished objects which may be carried in a hand-carried container are subject to continuous motion and shock and are easily scratched or marred without special care when carried about within such container.

A second preferred embodiment of the invention is illustrated in FIGS. 6 through 9.

Figure 6:
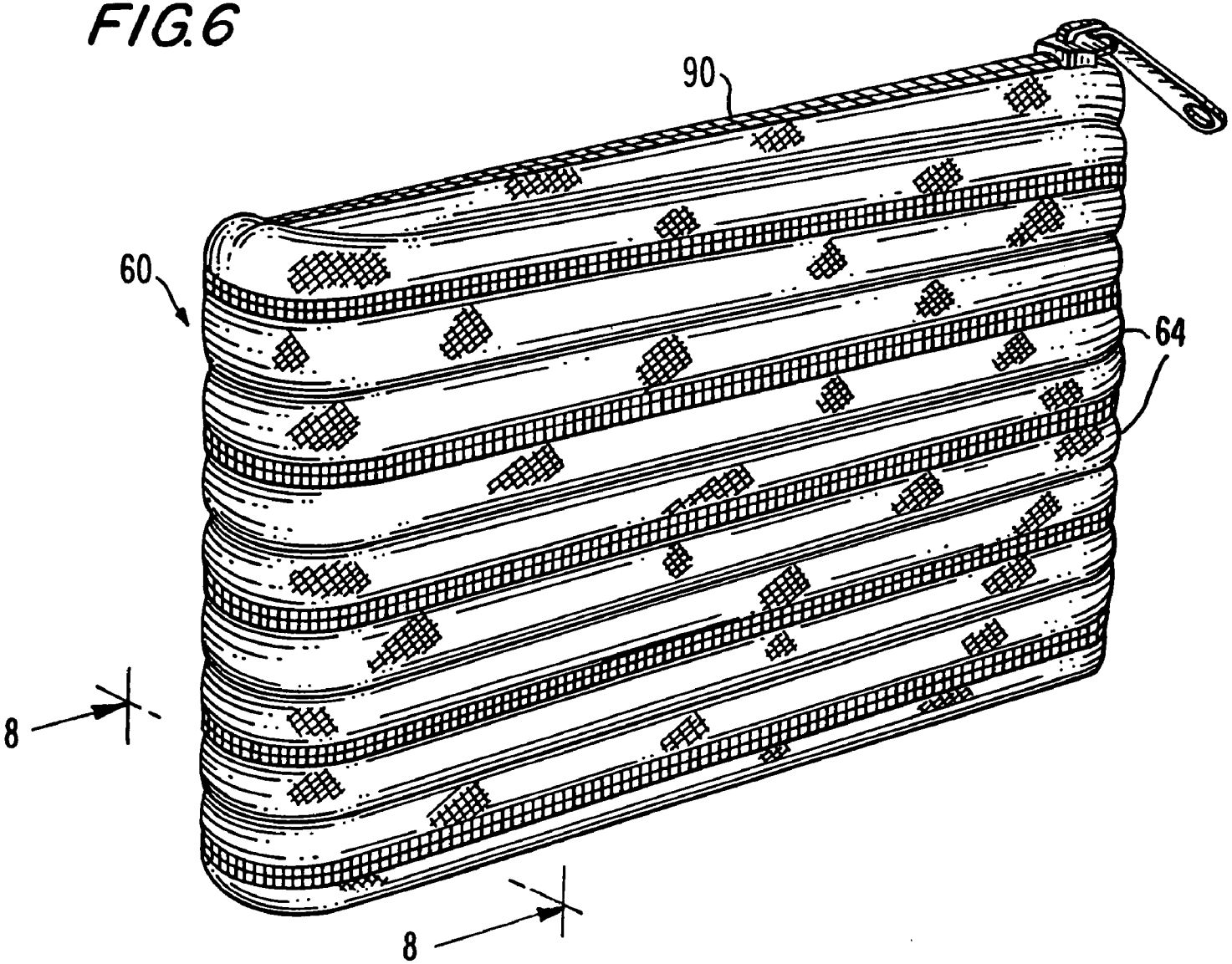
FIG. 6 is a perspective view of a second embodiment of the invention showing a fully formed hand-carried container constructed with a single elongated compound tape.

FIG. 6 is a perspective view of a fully formed handbag 60. The handbag 60 is constructed of successive tiers or sections of a compound slide fastener tape 64. The successive sections of the compound tape 64 are removeable but securely attached as described below. Although other fastener means such as interlocking velcro strips, or metallic snap fasteners other than slide fasteners may be applied to form the compound tape 64.

Figure 7:
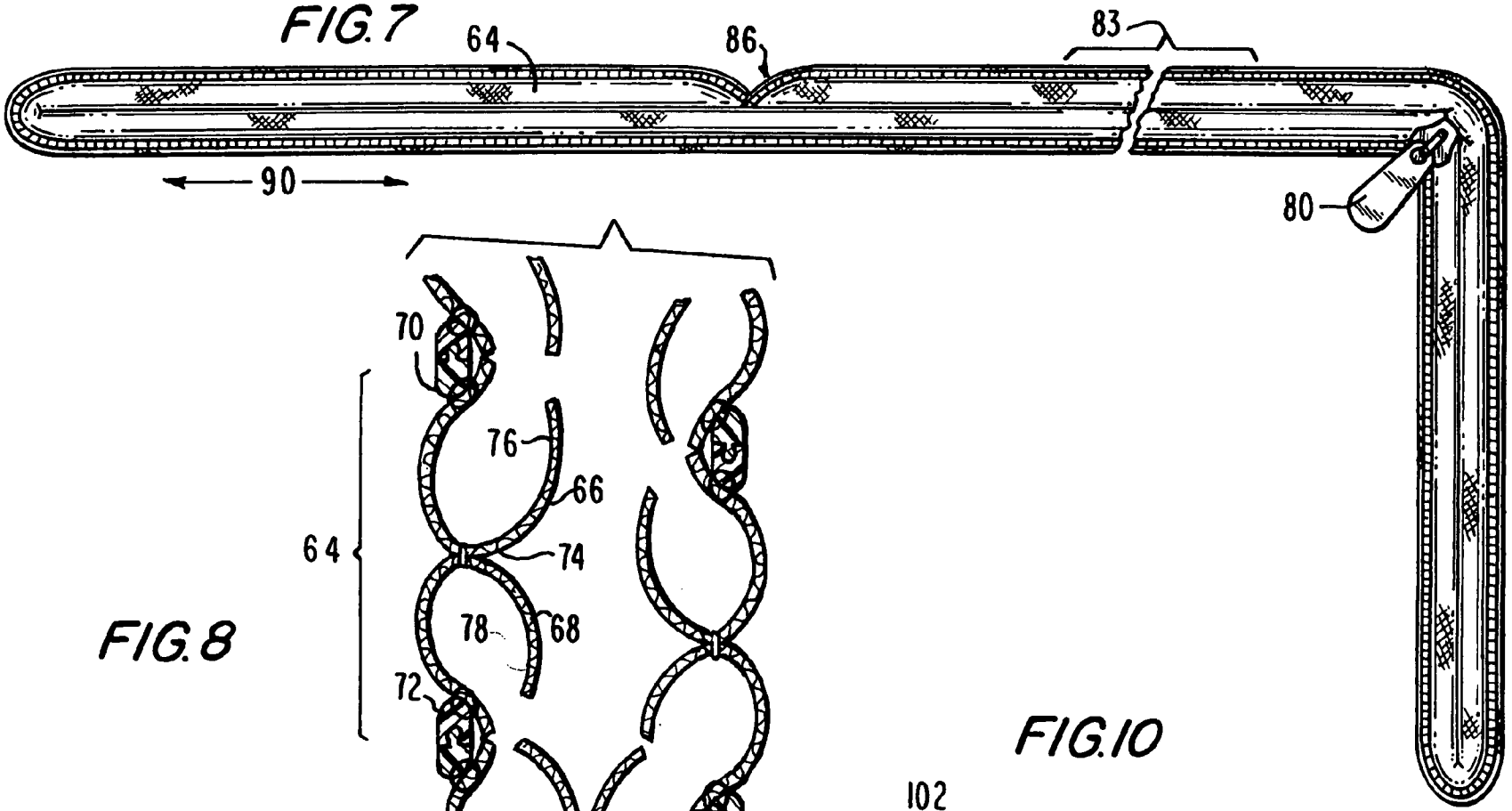
FIG. 7 shows a plan view of the elongated compound tape from which the hand carried container shown in FIG. 6 was formed.
Figure 8:
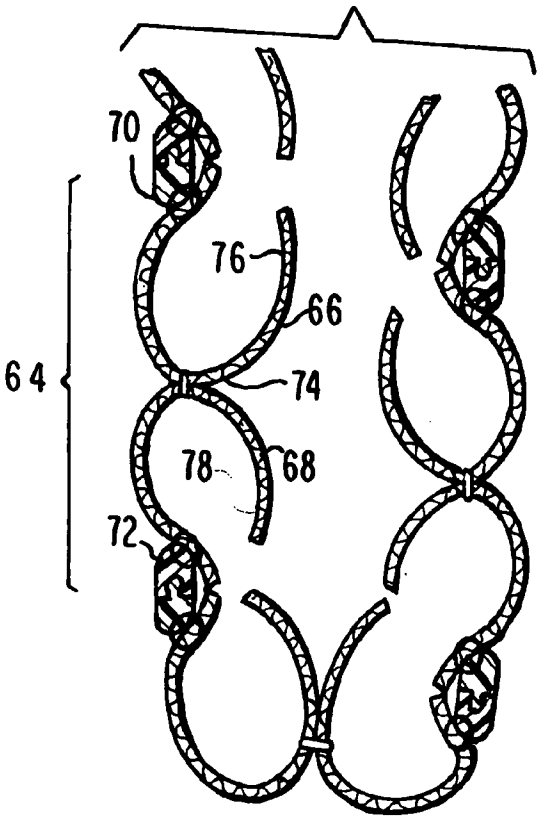
FIG. 8 is a cross section view taken on plane 8-8 as shown in FIG. 6.
Figure 10:
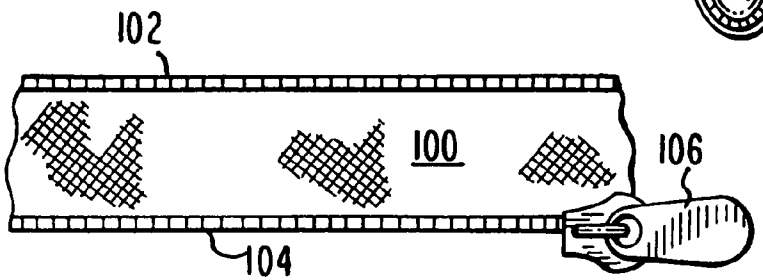
FIG. 10 shows a fragmentary view of a tape component of a container constructed similarly to that shown in FIG. 9, however, applicable for forming larger novel containers.

FIGS. 7 and 8 are illustrative of detail of the compound tape 64. FIG. 7 shows an extended plan view of the tape 64; FIG. 8 is a cross section view on plane 8-8 of FIG. 6 showing the compound tape 64 when assembled into a handbag 60 or other container.

The compound tape 64 is constructed of two slide fastener tapes 66 and 68. The two tapes 66 and 68 have slide fastener attachment teeth 70 and 72 fastened sequentially, respectively, along one peripheral edge of each of the elongated tapes 66 and 68. FIG. 6 illustrates the sequentially fastened sections of the compound tape 64 when formed into a handbag 60.

The slide fastener tapes 66 and 68 are fixedly secured together with a seam 74. The seam 74 which may be sewn or an adhesive is placed a measured distance from the respective edges where the slide fastener attachment teeth 70 and 72 are attached. Thus, two sections, 76 78 suitable for forming a longitudinal protective fold along and within the interior side of the handbag 60 or hand-carried container are left on or along the tapes 66 and 68.

Figure 9:
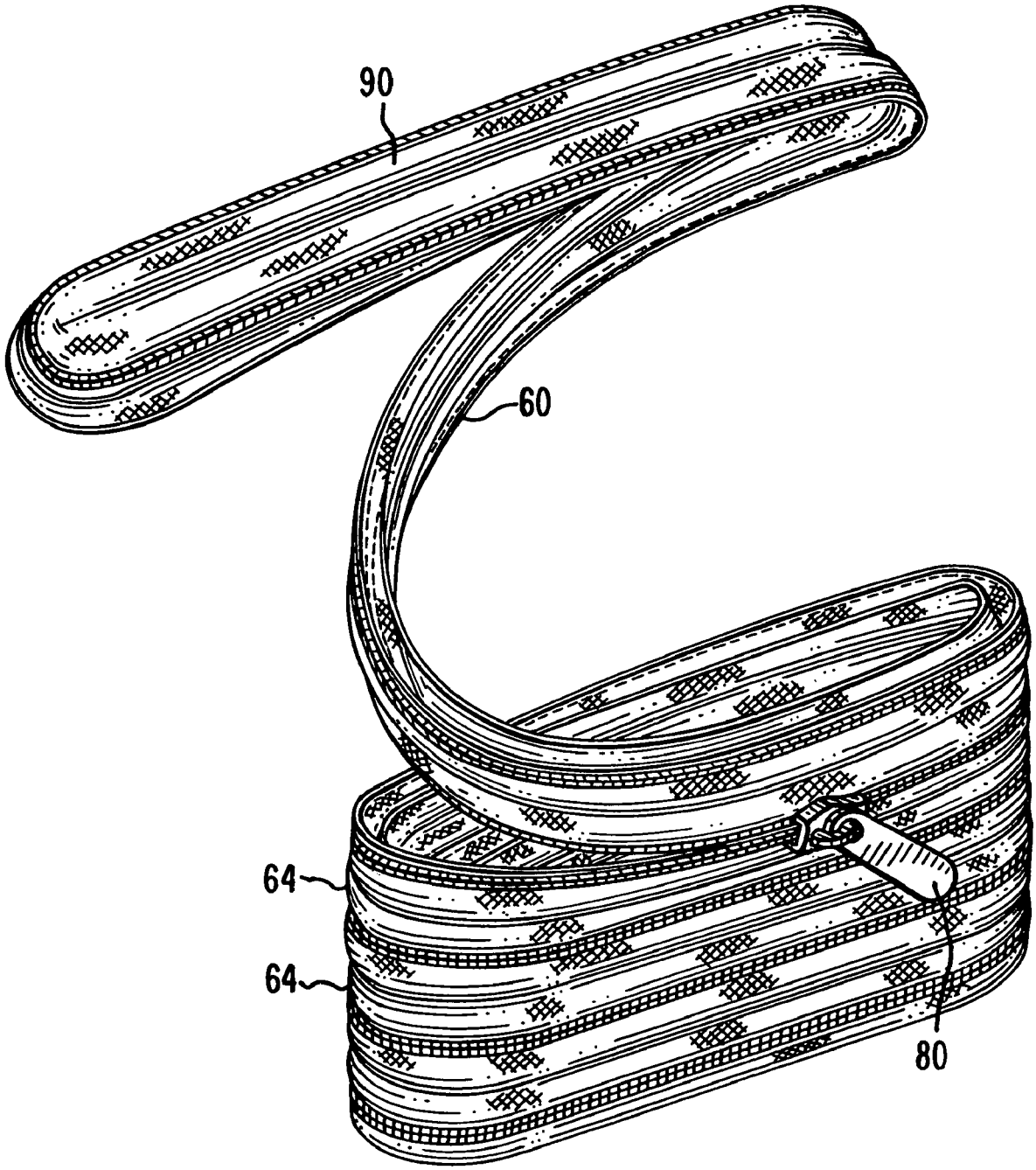
FIG. 9 is a perspective view in partly formed state of a second embodiment of my invention as shown in FIG. 6.

FIG. 7 and FIG. 9 shows a slide fastener moveable member 80 positioned as it is moved along two adjacent sections of the compound tape 64 to securely but removably fasten successive sections of the tape 64 together to form a handbag 60 or hand-carried container. The compound tape 64 when placed in a spiral configuration and successive sections or tiers are secured together provides a readily accessible exterior face and a protective folded fabric interior lining for the resultant handbag or container.

The compound tape 64 may be of an extended length as the break 83 shows, to form a hand-carried container of any desired size. A slide fastener end stop 86, positioned a measured distance from the end of the compound tape 64, facilitates forming a top or cover 90 of the handbag 60 or hand-carried container.

FIG. 9 illustrates a partly formed handbag 60 showing the slide fastener moveable member 80 fastening together sections of the compound tape 64 arranged as tiers in a spiral to form a closed handbag 60 or hand-carried container.

The compound tape 64 may be constructed with any of several secure but removeable peripheral fasteners such as the illustrated slide fasteners, interlocking velcro strips, metal snap fasteners or others.

Another preferred embodiment of the invention provides an elongated flexible tape 100 which may be fabric, leather, leather like material, or a polymer sheet material. Continuous fastener devices, such as slide fastener with engagement teeth, 102, 104 or interlocking velcro strips are fixedly attached along the edges of the tape 100. Larger containers may be formed by engaging sections of the tape 100 in a spiral configuration when a slide fastener mobile member 106 is moved to join successive spiral tiers of tape 100. By joining as illustrated successive tiers of the tape 100 to form a container may be formed with a closed bottom and a closed top or cover. FIG. 9 illustrates a tape 100 used to form a closed, but readily opened, container. The tape 100 made of heavier fabric or other material is applicable to forming larger containers.

The foregoing descriptions of improved embodiments of my inventions are intended as being illustrative, the scope and extent of my invention is more filly described in the following claims.

The invention claimed is:

1. A container suitable for hand carry formed with longitudinally fastened successive tiers of a spiraled elongated compound tape, the compound tape being comprised of two relatively wide elongated tapes, the wide elongated tapes having continuous attachment means fastened longitudinally adjacent one extended longitudinal edge of each tape, respectively, the two wide elongated tapes further being securely attached together longitudinally along the mid-sections thereof, the wide elongated tapes then having, respectively, longitudinal foldable tape material opposite the respective tape edges upon which fasteners have been fixedly attached, whereby successive spiraled sections of the compound tape may be attached to one another forming a container having an exterior and an interior, the exterior of the successive tiers of attached compound tape providing readily accessible access to the longitudinal fasteners and the interior of the successive tiers of attached compound tape being provided with a protective liner formed by the longitudinal folded tape material of the respective wide elongated tapes.

2. A container as described in claim 1 where in the attachment means are slide fasteners.

3. A container as described in claim 1 where in the successive tiers of sections of a compound tape are securely but removably fastened with interlocking slide fastener attachment teeth.

4. The container as described in claim 1 wherein the compound tape is provided with a longitudinal foldable tape section, the foldable tape section, when extended across the fasteners of successive tiers of the compound tape, forms a protective interior liner in the formed container.

5. The container described in claim 1 wherein a rigid flat panel of specified size and shape having a periphery is attached at a section of its periphery to the edge of one of the elongated tapes, the continuous attachment means extending along one edge of the longitudinal tape at a measured distance from the end of the tape being removed along the attachment length of the periphery of the flat panel and the continuous attach means being extended about the periphery of the flat panel except for the section of the periphery attached to the edge of the elongated tape, whereby, when the spiraled successive tiers of the compound tape are securely fastened together, the flat panel is positioned and secured as the bottom panel of the resulting container.

6. The container described in claim 1 wherein the elongated compound tape has a first end and a second end, a section of compound tape is attached a measured distance from the first end of the compound tape forming a branch section to the elongated compound tape, the continuous attachment means fastened longitudinally on the respective sides of the longitudinal compound tape and about the peripheral edges of the section of the attached tape, one end stop of the continuous attachment means is positioned on one side of the section of the compound tape at the junction of the longitudinal compound tape and the branch section, wherein the section of the compound tape, when successive tiers of the spiraled compound tape are securely fastened together, becomes the top or cover of the resulting container.

7. The elongated tape of claim 1 being made of an elongated wide strip of canvas fabric, leather, synthetic leather material or polymer sheet, the wide tape having edges along the peripheries thereof, the continuous removable attachment means being securely mounted on the edges of the wide tape, whereby the wide tape may be spiraled about to form a container when the continuous removable attachment means along respective tiered sections of the elongated wide tape are securely fastened together.

8. The continuous removable attachment means of claim 7 being a slide fastener with attachment teeth fixed continuously along both side edges of the wide tape and a slide fastener moveable member entrained between two tiers of the spiraled tape which upon movement securely fastens the spiraled tape tiers to form a container.

* * * * *